US009326563B2

(12) United States Patent
Svensson

(10) Patent No.: US 9,326,563 B2
(45) Date of Patent: May 3, 2016

(54) BASE FOR A SKI BOOT AND SKI BOOT INCORPORATING SUCH A BASE

(71) Applicant: John Erik Svensson, Vashon, WA (US)

(72) Inventor: John Erik Svensson, Vashon, WA (US)

(73) Assignee: K-2 Corporation, Seattle, WA (US)

( * ) Notice: Subject to any disclaimer, the term of this patent is extended or adjusted under 35 U.S.C. 154(b) by 382 days.

(21) Appl. No.: 13/662,336

(22) Filed: Oct. 26, 2012

(65) Prior Publication Data

US 2014/0115930 A1 May 1, 2014

(51) Int. Cl.

| | |
|---|---|
| ***A43B 13/18*** | (2006.01) |
| ***A43B 5/04*** | (2006.01) |
| ***A43B 13/02*** | (2006.01) |
| ***A43B 13/16*** | (2006.01) |

(52) U.S. Cl.

CPC ..... *A43B 5/0411* (2013.01); *A43B 5/0413* (2013.01); *A43B 13/026* (2013.01); *A43B 13/16* (2013.01)

(58) Field of Classification Search

CPC ..... A43B 13/12; A43B 13/186; A43B 5/06; A43B 13/14; A43B 13/38; A43B 17/02

USPC ..... 36/28, 117.1–117.5, 124, 67 A, 67 D, 36/59 C, 30 R, 44

See application file for complete search history.

(56) References Cited

U.S. PATENT DOCUMENTS 4,231,169 A 11/1980 Toyama
4,499,674 A 2/1985 Olivieri (Continued)

FOREIGN PATENT DOCUMENTS

DE 33 18 181 A1 11/1984
DE 20 2009 004 813 U1 11/2009

(Continued)

OTHER PUBLICATIONS

Partial European Search Report mailed Apr. 17, 2014, issued in corresponding European Application No. EP13186219, 7 pages.

(Continued)

*Primary Examiner* — Robert J Hicks
*Assistant Examiner* — Timothy K Trieu
(74) *Attorney, Agent, or Firm* — Christensen O'Connor Johnson Kindness PLLC

(57) ABSTRACT

A base (1) is provided for a ski boot (2) and comprises a one-piece sole (4) defining heel and toe portions (6, 7) that is adapted to be secured to one or more outsole elements (8, 9, 10). Preferably, toe and heel outsole elements (8, 9) are bonded to the toe and heel portions (6, 7) respectively to form a base (1) with a unitary construction. The sole (4) also has a fiber-reinforced composite structure wherein a majority of the fibers in at least a mid-section (7) of the sole (4) between the heel and toe portions (6, 7) are angled at an acute angle with respect to a longitudinal axis (L) of the sole (4). Preferably, the mid-section (7) of the sole covers a position anatomically beneath the location of the metatarsal bones and the plantar arch of a person wearing the ski boot and a majority of the fibers in this mid-section (7) of the sole are angled at substantially ±45°±10° to the longitudinal axis (L) of the sole (4) and between 5% and 10% of the fibers in the mid-section (7) of the sole (4) are substantially aligned with the longitudinal axis of the sole at angles within ±20° of being parallel to the longitudinal axis (L) of the sole (4). A ski boot (2) incorporating such a sole (4) is also provided.

34 Claims, 6 Drawing Sheets

(56) References Cited

U.S. PATENT DOCUMENTS

| | | | | |
|---|---|---|---|---|
| 4,562,653 | A | 1/1986 | Salomon | |
| 4,651,445 | A * | 3/1987 | Hannibal | 36/103 |
| 4,839,972 | A | 6/1989 | Pack | |
| 5,066,036 | A | 11/1991 | Broughton | |
| 5,311,677 | A * | 5/1994 | Mann et al. | 36/107 |
| 5,452,526 | A | 9/1995 | Collins | |
| 5,832,634 | A | 11/1998 | Wong | |
| 5,918,338 | A * | 7/1999 | Wong | 12/146 S |
| 5,992,861 | A | 11/1999 | Piotrowski | |
| 6,065,228 | A | 5/2000 | Begey | |
| 6,082,744 | A | 7/2000 | Allinger | |
| 6,168,184 | B1 | 1/2001 | Simonetti | |
| 6,202,326 | B1 | 3/2001 | Hauglin | |
| 6,216,366 | B1 | 4/2001 | Donnadieu | |
| 6,233,848 | B1 * | 5/2001 | Bonaventure | 36/89 |
| 6,289,610 | B1 | 9/2001 | Girard | |
| 6,685,213 | B2 | 2/2004 | Hauglin | |
| 6,782,642 | B2 | 8/2004 | Knoche | |
| 6,938,362 | B2 * | 9/2005 | Saillet et al. | 36/117.3 |
| 6,971,652 | B2 | 12/2005 | Bobbert | |
| 7,591,085 | B2 | 9/2009 | Hauglin | |
| 7,832,117 | B2 * | 11/2010 | Auger et al. | 36/30 R |
| 8,960,711 | B2 | 2/2015 | Svensson | |
| 2002/0092207 | A1 * | 7/2002 | Girard et al. | 36/117.3 |
| 2002/0178615 | A1 | 12/2002 | Saillet | |
| 2005/0280221 | A1 | 12/2005 | Haugen | |
| 2005/0280222 | A1 | 12/2005 | Sauter | |
| 2008/0127523 | A1 | 6/2008 | Hauglin | |
| 2009/0113763 | A1 | 5/2009 | Narajowski | |
| 2011/0107622 | A1 | 5/2011 | Schwirian | |
| 2012/0151801 | A1 | 6/2012 | Miette | |
| 2014/0115929 | A1 | 5/2014 | Svensson | |

FOREIGN PATENT DOCUMENTS

| | | | |
|---|---|---|---|
| EP | 0 712 587 | A1 | 5/1996 |
| EP | 0 815 756 | A1 | 1/1998 |
| EP | 2 250 916 | A1 | 11/2010 |
| EP | 2 465 371 | A1 | 6/2012 |
| FR | 2 336 152 | A1 | 7/1977 |
| FR | 2 358 117 | A1 | 2/1978 |
| FR | 2 887 178 | A1 | 12/2006 |
| FR | 2 971 675 | A1 | 8/2012 |
| GB | 2 256 784 | A | 12/1992 |
| WO | 91/09547 | A1 | 7/1991 |
| WO | 99/21625 | A1 | 5/1999 |
| WO | 02/052969 | A1 | 7/2002 |
| WO | 2007/150068 | A2 | 12/2007 |

OTHER PUBLICATIONS

"Cross-Country Skiing," Wikipedia.org, Jun. 17, 2007, <http://en.wikipedia.org/w/index.php?title=Cross-country_skiing&printable=yes> [retrieved Jun. 20, 2007], 11 pages.

Hale, P., "NIS: A Revolution in Nordic Bindings," Skinny Skis C-Corp, Jan. 17, 2006, <http://www.skinnyskis.com/article.aspx?id=10003> [retrieved Jun. 20, 2007], 3 pages.

International Search Report and Written Opinion mailed Feb. 21, 2013, issued in corresponding International Application No. PCT/US2012/068607, filed Jul. 12, 2012, 8 pages.

Muha, M., "Nordic Integrated System," NordicSkiRacer.com, Jan. 26, 2005, <http://www.nordicskiracer.com/Equipment/2005/NIS/NIS.asp> [retrieved Jun. 20, 2007], 5 pages.

"NIS—Nordic Integrated System," Madshus, n.d., <http://www.madshus.com/mhtemplates/Page.aspx?id=332> [retrieved Jun. 20, 2007], 2 pages.

* cited by examiner

BASE FOR A SKI BOOT AND SKI BOOT INCORPORATING SUCH A BASE

The present invention relates to a base for a ski boot, preferably but not exclusively a Nordic ski boot, and to a ski boot incorporating such base.

Although the word "boot" is used throughout this specification and in the claims, it should be interpreted broadly to include shoes and any form of footwear suitable for wear when taking part in skiing.

Ski boots are a specialized form of footwear that is used in skiing to provide a way of attaching the skier's feet to his/her skis via ski bindings. The ski boot should position the skier's body over the ski properly. The base of such a boot usually comprises rigid cleats or outsole elements that are used to fasten the boot to a ski binding. These outsole elements also comprise a walking surface for the boot. It is therefore important for the base of the boot, which incorporates the outsole elements, to provide strength and torsional stiffness yet still be sufficiently flexible for the intended form of skiing and for ease of walking. It is also important for the base to incorporate the outsole elements in a manner which retains them securely in a correctly orientated manner in order that the base will withstand the considerable demands placed upon it during use. Some conventional bases for ski boots are made from injection moulded plastic material in which the outsole elements, in particular an element comprising a front bar that is used to attach a Nordic ski boot to a binding, are moulded into the sole. It has been known for these bars to be pulled out of softer plastic material or for harder plastic material to shear off the outsole element around the bar when high loads have been placed on the bar during use causing the bar to deform relative to the ski boot within the enclosing plastic material. Deformation of the bar, in any event, has a negative effects on ski control. Also, such bases rarely provide the necessary degree of torsional stiffness required to prevent permanent deformation of the boot from happening over time when the boot is in use It is an aim of the present invention to overcome or substantially mitigate the aforementioned problems and to provide a base and a ski boot incorporating such a base that provides sufficient strength and torsional stiffness to obviate or substantially mitigate permanent deformation of the boot from occurring and that will with stand, in-use, high post clamping forces, preferably those of at least 68,950 $N/m^2$ (10 psi), after connection to a ski binding.

According to a first aspect of the present invention there is provided a base for a ski boot comprising a one-piece sole defining heel and toe portions that is adapted to be secured to one or more outsole elements and that has a fiber-reinforced composite structure wherein a majority of the fibers in at least a mid-section of the sole between the heel and toe portions are angled at an acute angle with respect to a longitudinal axis of the sole.

Preferably, the mid-section of the sole covers a position anatomically beneath the location of the metatarsal bones and the plantar arch of a person wearing the ski boot.

Preferably also, toe and heel outsole elements are bonded to the toe and heel portions of the sole respectively to form a unitary construction.

Preferably also, a majority of the fibers in the mid-section of the sole are angled at an acute angle of substantially ±45°±10° to the longitudinal axis of the sole.

Preferably also, substantially the remainder of the fibers in the mid-section of the sole are either substantially aligned with the longitudinal axis of the sole at angles within ±20° of being parallel to the longitudinal axis or are angled at 90°±20° to the longitudinal axis of the sole.

Preferably also, between 5% and 10% of the fibers in the mid-section of the sole are substantially aligned with the longitudinal axis of the sole at angles within ±20° of being parallel to the longitudinal axis of the sole.

Preferably also, over 80% of fibers in the mid-section of the sole are angled at substantially 45°±10° to the longitudinal axis of the sole.

Preferably also, the fiber-reinforced composite structure comprises a laminate wherein a plurality of layers of woven fabric comprising warp carbon fibre yarns and weft carbon fibre yarns are encapsulated within a polymer matrix, which is preferably an epoxy-based resin.

Preferably also, the layers of woven fabric are each woven in a balanced plain weave.

Preferably also, the layers of the woven fabric are orientated relative to one another and to the longitudinal axis of the sole such that in some of the layers the warp or weft yarns are angled with respect to the longitudinal axis of the sole and in at least one of the layers the warp yarns or the weft yarns are aligned with the longitudinal axis of the sole.

Preferably also, the laminate comprises at least seven layers of woven fabric. Advantageously, at least six of the layers are orientated such that their warp and weft yarns are angled at ±45°±10° to the longitudinal axis of the sole and a seventh layer is orientated such that either its warp yarns or its weft yarns are substantially aligned with the longitudinal axis of the sole at angles within ±20° of being parallel to the longitudinal axis of the sole. Advantageously, the laminate comprises seven layers and said seventh layer is located centrally of the laminate between three outer layers on either side thereof.

In another embodiment, the laminate comprises eight layers of woven fabric of which seven layers are orientated such that their warp and weft yarns are angled at ±45°±10° to the longitudinal axis of the sole and the eighth layer is orientated such that its warp yarns or its weft yarns are substantially aligned with the longitudinal axis of the sole at angles within ±20° of being parallel to the longitudinal axis.

Preferably also, the outsole elements comprise rigid elastomeric elements that are bonded to the sole via an adhesive.

Preferably also, an outsole element comprising a rigid bar is fastened to the sole adjacent or at a forward end of said toe outsole element via at least two fasteners.

Preferably also, the outsole element comprising the rigid bar is fastened to the sole at the forward end of said toe outsole element, the fasteners penetrating through the toe outsole element into the sole.

Preferably also, the fasteners penetrate through the sole.

Preferably also, the base comprises a heel portion integrally formed with an upstanding portion that is adapted to wrap up around the back and sides of the heel of the ski boot.

Preferably also, the upstanding portion is adapted for connection to an ankle cuff.

Preferably also, the heel portion of the sole defines an interior cavity. Advantageously, a resilient pad is secured within the cavity to provide heel lift and to cushion the foot during use.

Preferably also, one of the outsole elements and the sole is provided with at least two projections that locate in holes or cavities defined by the other whereby said outsole element is secured to the sole in a predetermined position.

Preferably also, the projections are integrally formed with said outsole element. Alternatively, the projections are formed by injected pins, rivets, fasteners, t-nuts, or screws that locate into the cavities or holes defined by the sole.

According to a second aspect of the present invention there is provided a ski boot incorporating a base comprising a one-piece sole to which is secured one or more outsole elements, the one-piece sole having a fiber-reinforced composite structure wherein a majority of the fibers in at least a mid-section of the sole are angled at an acute angle with respect to a longitudinal axis of the sole.

Preferably, the mid-section of the sole is located between toe and heel portions of the sole to which portions are secured toe and heel outsole elements respectively.

Preferably also, the toe and heel outsole elements comprise rigid elastomeric elements that are bonded to the sole via an adhesive.

Preferably also, an outsole element comprising a rigid bar is fastened to the sole adjacent or at a forward end of said toe outsole element via at least two fasteners that penetrate through the sole.

Preferably also, the outsole element comprising the rigid bar is fastened directly to the sole adjacent said toe outsole element. Alternatively, the forward end of said toe outsole element is located between the outsole element comprising the rigid bar and the sole and the fasteners penetrate through the toe outsole element into and through the sole.

Preferably also, the ski boot has a flexible fabric upper.

Preferably also, the base comprises a heel portion integrally formed with the sole, which heel portion is wrapped up around the back and sides of the heel of the ski boot.

Preferably also, the heel portion is connected to an ankle cuff in a hinged manner.

The various aspects of the present invention will now be described by way of example with reference to the accompanying drawings, in which.

Figure 1:
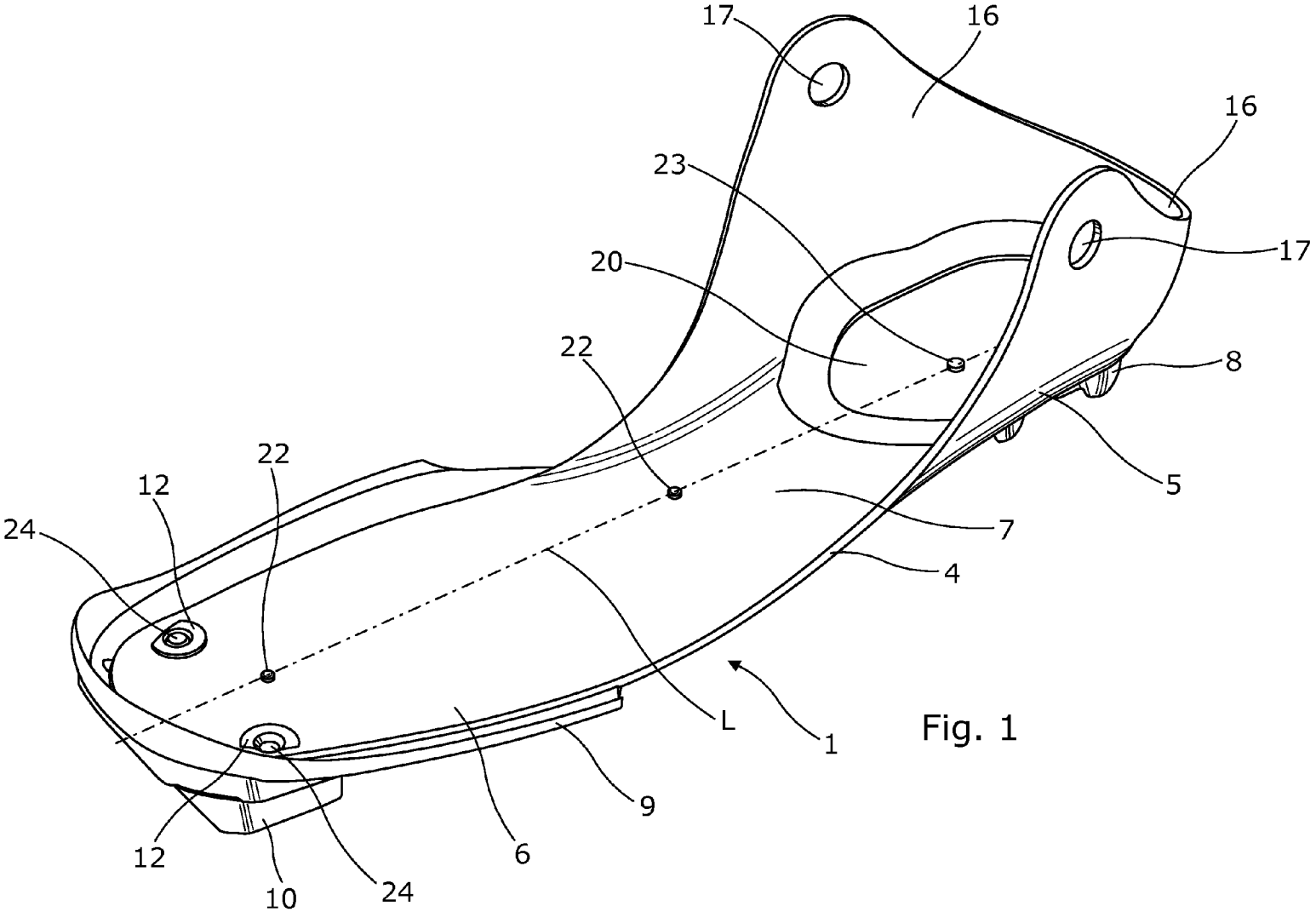
FIG. 1 is a perspective view from above and one side of a base for a ski boot in accordance with the first aspect of the present invention.
Figure 2:
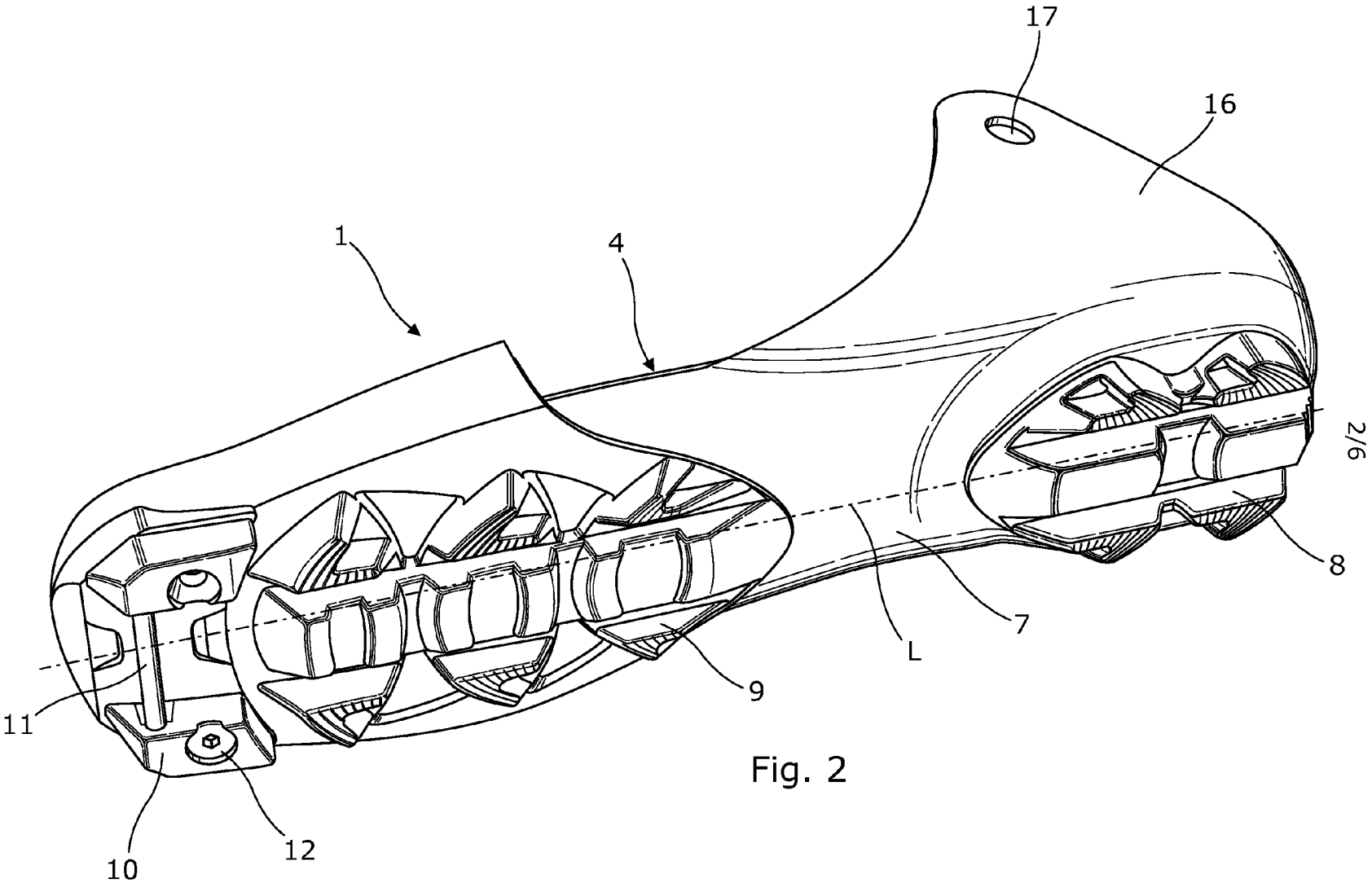
FIG. 2 is a perspective view from below and said one side of the base shown in FIG. 1.
Figure 3:
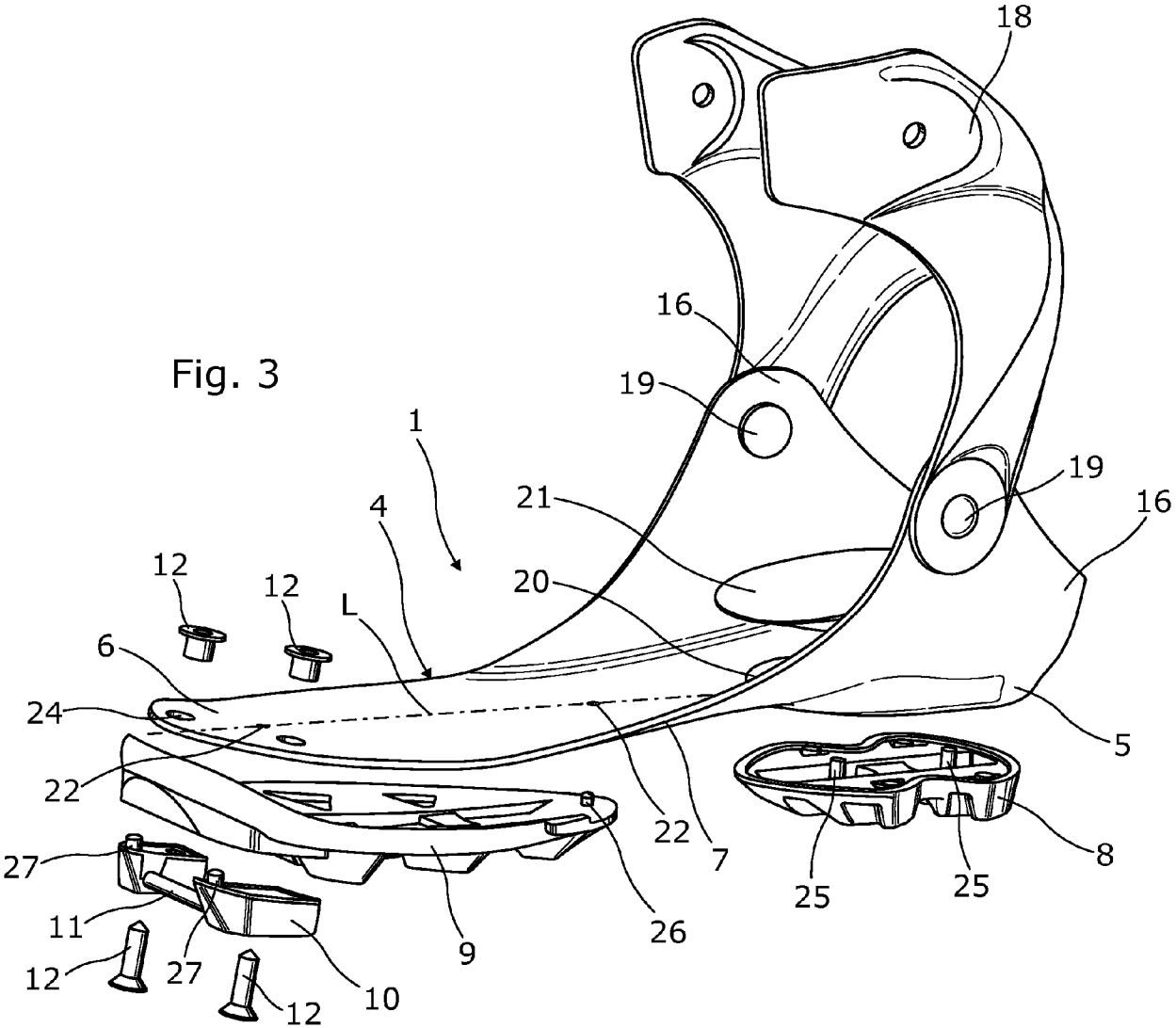
FIG. 3 is an exploded view of the base shown in FIGS. 1 and 2 along with a cuff for attachment to the base.
Figure 4A:
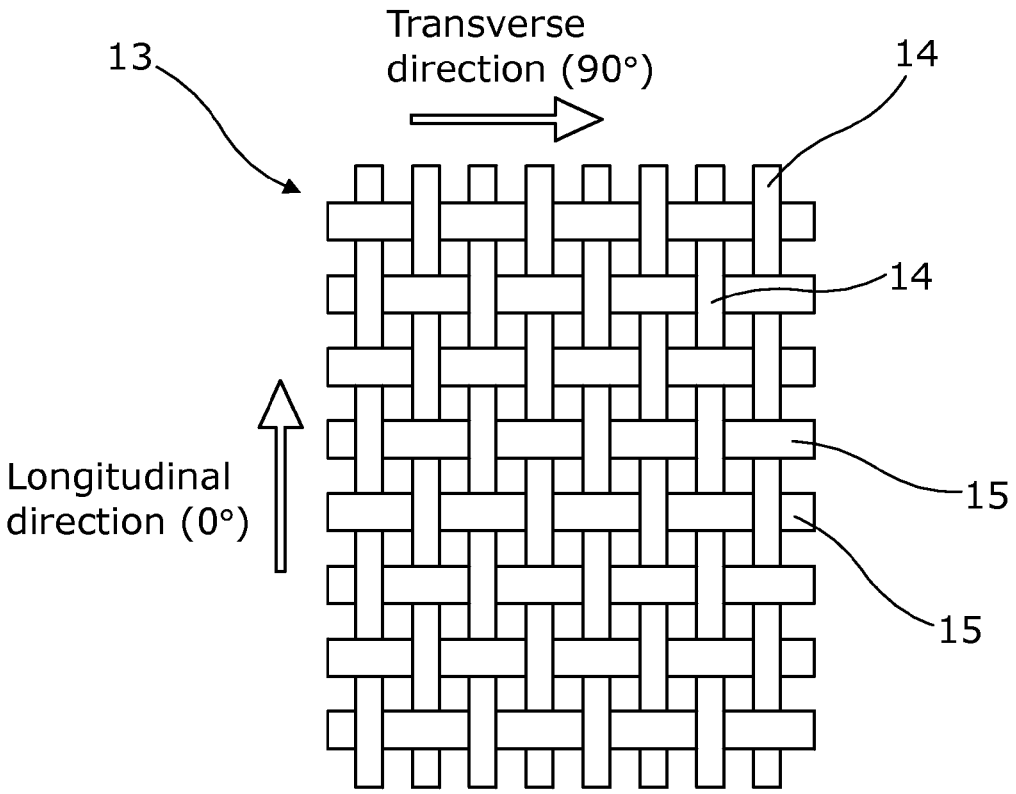
Figure 4B:
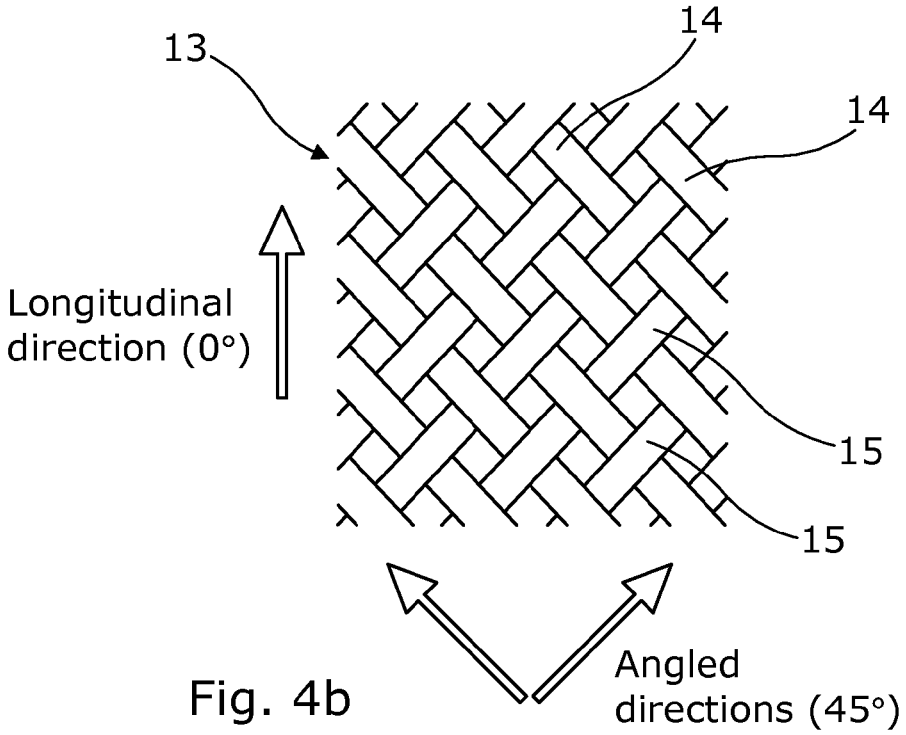
Figure 5:
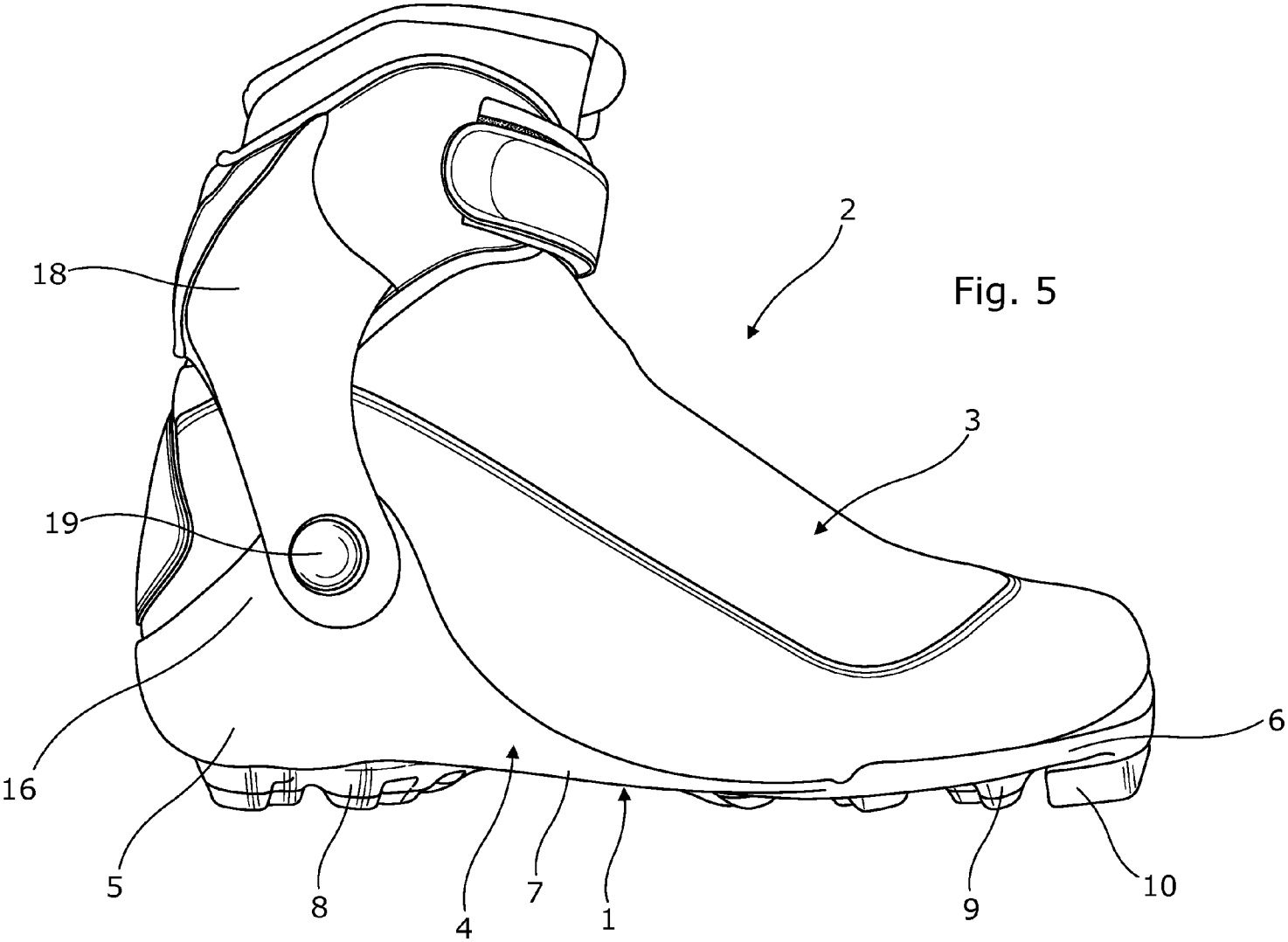
Figure 6:
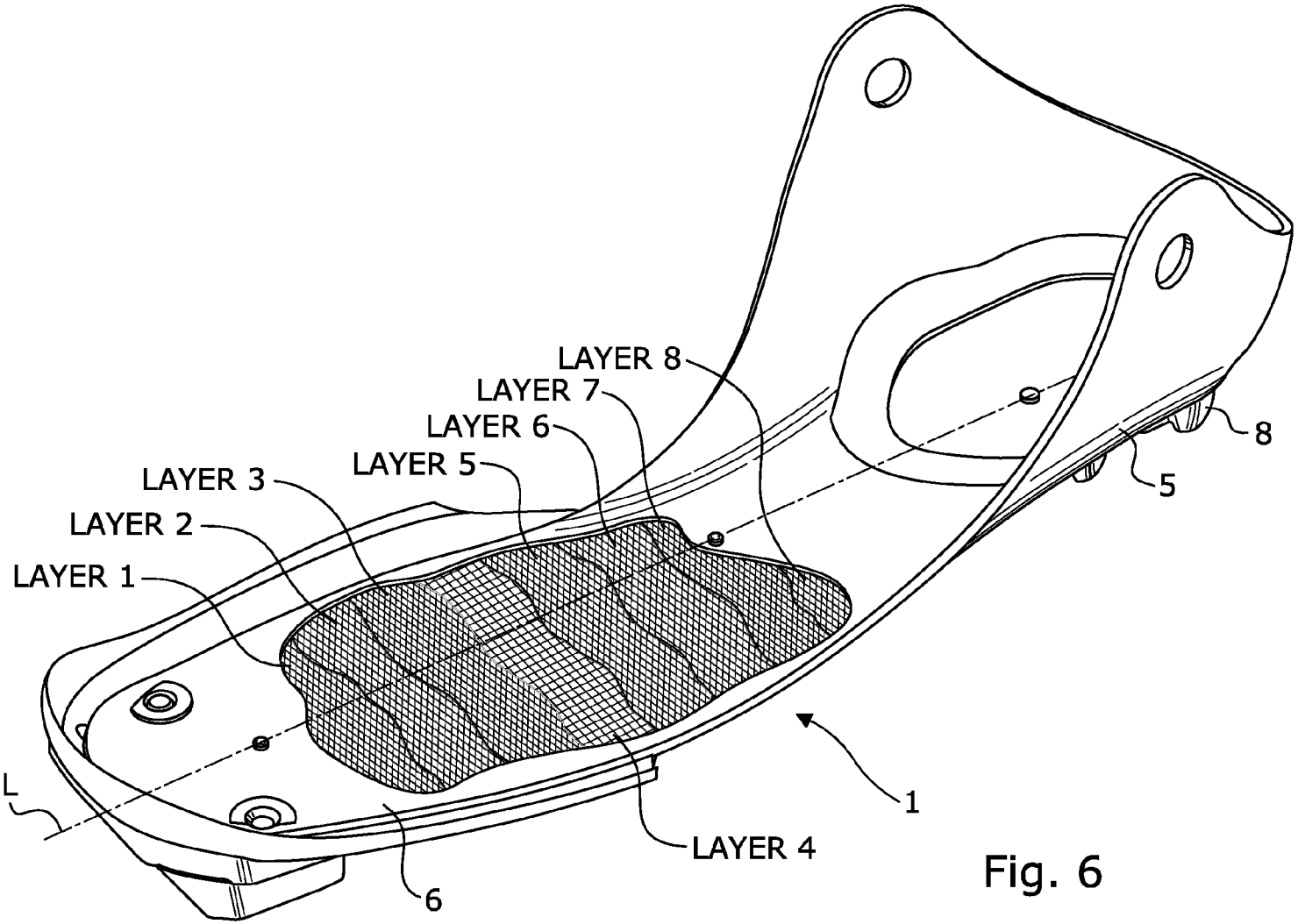

FIGS. 4*a* and 4*b* are schematic representations, to an enlarged scale, of two layers of a laminate used to form the base shown in FIGS. 1 to 3 and illustrating the manner in which the layers are oriented relative to a longitudinal axis of the base;

FIG. 5 is a side view of a ski boot in accordance with the second aspect of the present invention that incorporates a base as shown in FIGS. 1 to 3; and FIG. 6 is a cutaway perspective view of the base for a ski boot shown in FIG. 1.

FIGS. 1 to 3 of the drawings show a base 1 adapted for use on a Nordic ski boot and an example of such a boot 2 having an upper 3 is shown in FIG. 5. However, it should be appreciated that the invention is not limited to such ski boots and by appropriate choice of outsole elements, as described below, a ski boot with a universal boot upper 3 or shell can be produced for use in various types of skiing, e.g. downhill, cross-country, ski-jumping, Telemark, etc.

The upper 3 is configured to encase a wearer's foot and is equipped with appropriate conventional fastening arrangements which will not be described here as the present invention is primarily concerned with the base 1 of the boot 2. The base 1 comprises a one-piece sole 4 defining heel and toe portions 5 and 6 respectively and a mid-section 7 that is located between the heel and toe portions 5 and 6 in a position anatomically beneath the location of the metatarsal bones and the plantar arch of a person wearing the ski boot 2. The heel and toe portions 5 and 6 are adapted to be secured to one or more rigid elastomeric outsole elements 8, 9, 10 to form a base 1 that can then be connected to the upper 3 during manufacture of the boot 2. Generally, therefore, the heel and toe portions 5 and 6 of the sole 4 lie adjacent respective heel and toe outsole elements 8 and 9. In the illustrated embodiment, the heel and toe outsole elements 8 and 9 respectively are permanently bonded to the heel and toe portions 5 and 6 of the sole 4 to form a base 1 of unitary construction that can then be secured to the upper 3. However, the outsole element 10 comprises a rigid bar 11 and is fastened, possibly in a releasable manner via releasable fasteners 12, to the sole 4 at a forward end of the toe outsole element 8. The fasteners 12 therefore penetrate through the toe outsole element 9 into the sole 4. Preferably, the fasteners 12 also penetrate through the sole 4 so that they can be unfastened and the outsole element 10 detached and replaced, if necessary. In an alternative arrangement (not shown) the outsole element 10 may be secured directly to the sole 4 adjacent a forward end of the toe outsole element 9, which in this case does not need to extend as far as the front tip of the sole 4.

The method of aligning and attaching the outsole elements 8, 9 and 10 to the sole 4 is described in more detail below. These outsole elements 8, 9, 10 locate between the sole 4 and a ski binding and least one of them, namely element 10 in the present example, is adapted for attachment to a Nordic ski binding. In other embodiments (not shown), one or more of the other outsole elements 8, 9 may also be adapted for securement to a ski binding in place of or in addition to the outsole element 10 to fit the base for attachment to different types of ski boot. In addition, the heel and toe outsole elements 8 and 9 provide walking surfaces that contact the ground when the boot 2 is not connected to a ski binding.

The construction of the base 1 will now be described in more detail.

The sole 4 has a fiber-reinforced composite structure wherein a majority of the fibers in the mid-section 7 of the sole 4 are angled at an acute angle with respect to a longitudinal axis L of the sole 4. In the present example this is achieved by manufacturing the sole 4 in the form of a laminate wherein a plurality of layers 13 of woven fabric comprising warp yarns 14 and weft yarns 15 are encapsulated within a polymer matrix. Preferably the warp yarns 14 and the weft yarns 15 are both carbon-fiber yarns and the polymer matrix is preferably an epoxy-based resin. The sole 4 is therefore moulded in a known manner, for example using a vacuum bag moulding process wherein a plurality of polymer-coated fabric layers 13 are laid up one on top of the other over a rigid mould to which suction is applied and the polymer is cured using heat and pressure applied via a flexible membrane or bag. The individual fibres of the fabric layers 13, which generally align along the longitudinal axis of the yarn in which they are incorporated, are therefore encapsulated by the polymer matrix so that the resulting moulded sole 4 has strength yet retains flexibility.

It is generally thought that it is important for the sole 4 to have isotropic qualities so that its stiffness properties are substantially the same in all directions. To achieve this the fabric layers 13 making up the laminate would be orientated so that half of them have either their warp yarns 14 or their weft yarns 15 aligned with the longitudinal axis L of the sole 4, as shown in FIG. 4*a*, but the other half of the fabric layers 13 would be orientated so that their warp yarns 14 and their weft yarns 15 are orientated at ±45° to the longitudinal axis L of the sole 4, as shown in FIG. 4*b*. For example, such a laminate may have 8 layers in total wherein 4 first layers have their warp or weft yarns 14, 15 aligned with the axis L and 4 second layers have their warp and weft yarns 14, 15 orientated at ±45° to the axis L. Typically, the first and second layers are arranged alternately within the laminate. Hence, it will be seen that half of the warp and weft yarns 14, 15 are arranged at ±45° to the axis L, a quarter are aligned with the axis L and the remaining quarter are orientated transversely at ±90° to the axis L. However, whilst the fibers angled at ±45° to the axis L provide torsional stability to the resulting sole 4 enabling boots with such soles to support a skier skiing on the edge of the skis, it has been found that such an arrangement is not ideal because the flexing stiffness of the resulting sole 4 in the longitudinal direction along the axis L is high and torsional stiffness is only moderate. The skier would feel this in the ball of the foot region and it would make the boot difficult to walk in. It also influences the feel of the boot during skiing.

In preference, a more optimal relationship between flexure and torsion is required, namely a high torsional stiffness and a moderate to low flexural stiffness. Hence, in accordance with the present invention, the fabric layers 13 making up the laminate are arranged so that a majority, that is more than half, of the fibers forming the warp and the weft yarns 14, 15 in at least the mid-section 7 of the sole 4 and beneath the ball of the foot are angled at an acute angle with respect to the longitudinal axis L of the sole 4. Preferably, the remainder of the fibers forming the warp and weft yarns 14, 15 in the mid-section 7 of the sole 7 are either substantially aligned with the longitudinal axis L at angles within ±20° of being parallel to the axis L or are angled transversely at 90°±20° to the axis L. This is because it has been found that if there are no fibers aligned or substantially aligned with the longitudinal axis L, the sole 4 can become permanently deformed during prolonged use.

Advantageously, however, the quantity of fibers in the laminate that is substantially aligned with the longitudinal axis L is substantially reduced over the isotropic example above. Surprisingly, it has been found that a non-isotropic arrangement wherein less than 10% of the fibers, but preferably no less than 5%, are aligned with the longitudinal axis L and more than half are arranged at 45°±20° to the axis L provides substantially increased torsional stiffness, which is an advantage, without the longitudinal stiffness being reduced sufficiently to allow the resulting boot to become permanently deformed during repeated use. In this regard it should be understood that a degree of latitude must be allowed for in the angling of the fibers as absolute precision is difficult and whilst angling at 45° is preferred, angling at a small degree of variation from 45°, say ±10°, still provides acceptable results.

In a first preferred embodiment of base 1 in accordance with the present invention, the sole 4 is made of a laminate comprising 7 layers of balanced plain weave fabric arranged with their warp and weft yarns 14, 15 orientated as follows with respect to sole 4 as a whole, including the mid-section 7.

| | |
|---|---|
| Layer 1 | ±45° to the axis L |
| Layer 2 | ±45° to the axis L |
| Layer 3 | ±45° to the axis L |
| Layer 4 | 0/90° to the axis L |
| Layer 5 | ±45° to the axis L |
| Layer 6 | ±45° to the axis L |
| Layer 7 | ±45° to the axis L |

In this regard it should be understood that a degree of latitude must be allowed for in the angling of the fibers as absolute precision is difficult and whilst angling at 45° is preferred, angling at a small degree of variation from 45°, say ±10°, is still within the scope of the invention. Similarly, with regard to the fibers angled at 90° to the longitudinal axis L of the sole 4 some degree of latitude, say ±20° must be allowed for in the angling of the fibers.

Also, it is assumed that the woven layers 13 are all woven in balanced plain weaves, as shown in FIGS. 4*a* and 4*b*. A plain weaves being one wherein the warp yarns 14 and the weft yarns 15 form a simple criss-cross pattern with each warp yarn 14 crossing the weft yarns 15 by going over one, then under the next, and so on, the next warp 14 yarn going under the weft yarns 15 that its neighbour went over, and vice versa. A balanced plain weave produces a fabric in which the warp yarns 14 and the weft yarns 15 are made of yarns of the same weight (size) and have the same number of ends per unit length as picks per unit length. However, it will be appreciated by a man skilled in the art that other weave patterns and weave balances could be employed but that the design considerations as above should still hold so that the resulting laminate has same proportion of fibers aligned in the desired directions relative to the longitudinal axis L.

It will be appreciated that in this example only around 7% of the fibers in the warp and weft yarns 14, 15 of the laminate as a whole are aligned with the longitudinal axis L and over 85% of the fibers in the warp and weft yarns 14, 15 are orientated at ±45° to the axis L. It has been found that such an arrangement increases the torsional stability of the sole 4 by approximately 50% over the isotropic example given above while decreasing the longitudinal stiffness by around a 33%. Such an arrangement maximizes the torsional stiffness of a boot 2 incorporating such a sole 4 while optimizing its longitudinal stiffness. This is a significant advantage in use as it increases the performance of the boot, enabling a skier to ski with confidence on the edge of the skis with the boot distorting.

In a second preferred embodiment of base 1 as shown in FIG. 6, the sole 4 is made of a laminate comprising 8 layers of balanced plain weave fabric arranged with their warp and weft yarns 14, 15 oriented as follows with a respect to sole 4 as a whole, including the mid-section 7.

| | |
|---|---|
| Layer 1 | ±45° to the axis L |
| Layer 2 | ±45° to the axis L |
| Layer 3 | ±45° to the axis L |
| Layer 4 | 0/90° to the axis L |
| Layer 5 | ±45° to the axis L |
| Layer 6 | ±45° to the axis L |
| Layer 7 | ±45° to the axis L |
| Layer 8 | ±45° to the axis L |

In this example around 6% of the fibers in the warp and weft yarns 14, 15 of the laminate as a whole are aligned with the longitudinal axis L and over 87% of the fibers in the warp and weft yarns 14, 15 are orientated at ±45° to the axis L.

In addition to the laminate structure of the sole 4 described above, the sole 4 is preferably moulded with a heel portion 5 that comprises upstanding portions 16 which wrap up around the back and sides of the heel of the ski boot 3. The upstanding portions 16 at the sides of the sole 4 may be provided with moulded-in holes 17 to enable an ankle cuff or part of an ankle cuff 18, as shown in FIG. 3 to be connected to the sole 4, for example by rivets 19, in a hinged manner. The part of the cuff 18 shown in FIG. 3 may be made of woven carbon fiber material similar to the sole 4, the rest of the cuff 18 being made from other fabric and comprising a fastener as shown in FIG. 5. The upstanding portion at the rear of the sole 4 forms a heel counter that provides a direct transfer of loads from the cuff 18 of the boot 2 into the base 1 of the boot, which is a significant advantage. The three-dimensional shape of the heel portion 5 of the sole 4 also increases the torsional stiffness of the boot 2 and increases its bending or flexural stiffness, which increases the performance of the boot 2 in use as indicated above.

In addition to the foregoing, the heel portion 5 of the sole 4 is moulded to define an interior cavity 20 into which is bonded a resilient pad 21. The pad 21 is dimensioned to provide a predetermined heel lift and made of a suitable material that will cushion the foot during use.

After moulding of the sole 4 as described above, the outsole elements 8 and 9 are bonded thereto to form the base 1 that can then connected to a boot upper 2, which is preferably a flexible fabric upper, in a conventional way. The outsole elements 8 and 9 are preferably made of a resilient material, such as rubber or a similar synthetic material, so as to cushion the foot during skiing. When this material is softer it gives a smoother, softer feeling in the ice conditions. It is also more comfortable during walking before and after skiing, especially on hard surfaces like cement and asphalt. If this material is harder it gives a more stable, direct, rigid contact platform that is an advantage in unstable softer snow conditions.

It is important for the outsole elements 8, 9 and 10 to be orientated correctly with regard to the longitudinal axis L of the sole 4 so that the boot can be properly attached to a ski binding and sit in the correct alignment with regard to the ski. This is often a difficult procedure and slight misalignment of the outsole elements 8 and 9 can seriously affect the ski binding attachment capability of the resulting boot and the ski alignment with respect to the boot.

In order to facilitate the correct alignment of the outsole elements 8, 9 and 10, the sole 4 is moulded with three pairs of cavities or holes 22, 23 and 24 in addition to the through-hole 17 for attachment of the cuff 18. The pairs of cavities or holes 22, 23 and 24 are precisely located in the sole 4 with respect to the longitudinal axis L. The first pair 22 is located respectively towards the front and rear ends of the toe portion 6 of the sole 4 whereas the second pair 23 is located respectively towards the front and rear ends of the heel portion 5 of the sole 4. Both of the pairs of cavities or holes 22, 23 align along the longitudinal axis L of the sole 4 and are used to locate the outsole elements 8 and 9 in the correct positions on the sole 4. To this end, each of the outsole elements 8 and 9 is provided with a pair of projections, 25 and 26 respectively that can be fitted into the respective pair of cavities or holes 22, 23 during attachment of the elements 8 and 9 to the sole 4. This ensures that the outsole elements 8 and 9 are positioned and orientated correctly with regard to the sole 4. The projections 25 and 26 may be unitary with the moulded material forming the rest of the elements 8 and 9 or may comprise injected pins, rivets, fasteners, t-nuts, screws or other secure alignment fastening means than can be located into the cavities or holes 22 and 23.

In the case of the pair of holes 24, these are located at the forward end of the sole 4 on either side of the longitudinal axis L and accommodate the fasteners 12 used to secure the outsole element 10 that comprises the rigid bar 11. These holes 24 are therefore preferably through holes so that the fasteners 12 can penetrate through the sole 4 rather than being cavities or blind holes, which is a possibility with the pairs of cavities or holes 22 and 23. In the present embodiment the outsole element 10 sits beneath the toe outsole element 9 and in order to align the two elements 10 and 9 together, a pair of projections 27 on one, in this case the element 10, that locate in cavities or holes (not shown) in the other may also be provided.

Hence, the outsole elements 8, 9 and 10 and the sole 4 can all be precisely aligned together relative to the centreline of the medial to lateral balance point of a ski. In particular, the outsole elements 8, 9 and 10 and the sole 4 can all be precisely aligned together in a forward and aft manner to form a base 1 that is individually adapted for a particularly sized upper to achieve a particular skier's optimal forward, aft balance point, side-to-side alignment and ideal power transfer zone and pivot point. Hence, a ski boot 2 can be manufactured to a skier's precise requirements.

The invention claimed is:

1. A base for a ski boot comprising a one-piece sole defining heel and toe portions that is adapted to be secured to one or more outsole elements and that has a fiber-reinforced composite structure comprising a laminate having a plurality of fibers encapsulated in a matrix defining a plurality of layers, wherein a majority of the fibers in at least a mid-section of the sole between the heel and toe portions are angled at an acute angle with respect to a longitudinal axis of the sole;

wherein the majority of the fibers in the mid-section of the sole are angled at an acute angle of substantially ±45°±10° to the longitudinal axis of the sole and are disposed in a first plurality of layers, and further wherein substantially the remainder of the fibers in the mid-section of the sole are either angled within ±20° of parallel to the longitudinal axis of the sole or are angled at 90°±20° to the longitudinal axis of the sole and are in one or more layers disposed between layers of the first plurality of layers.

2. The base as claimed in claim 1, wherein the mid-section of the sole covers a position anatomically beneath the location of the metatarsal bones and the plantar arch of a person wearing the ski boot.

3. The base as claimed in claim 1, wherein the one or more outsole elements comprise toe and heel outsole elements that are bonded to the toe and heel portions of the sole respectively to form a unitary construction.

4. The base as claimed in claim 3, wherein the one or more outsole elements further comprise a rigid bar outsole element that is fastened to the sole adjacent or at a forward end of the toe outsole element via at least two fasteners.

5. The base as claimed in claim 3, that is secured to an upper to form a ski boot.

6. The base as claimed in claim 4, wherein the rigid bar outsole element is fastened to the sole at the forward end of the toe outsole element, and further wherein the fasteners extend through the toe outsole element into the sole.

7. The base as claimed in claim 4, wherein the fasteners penetrate through the sole.

8. The base as claimed in claim 1, wherein between 5% and 10% of the plurality of fibers in the mid-section of the sole are oriented within 20° of parallel to the longitudinal axis of the sole.

9. The base as claimed in claim 1, wherein more than 80% of the plurality of fibers in the mid-section of the sole are angled at 45°±10° to the longitudinal axis of the sole.

10. The base as claimed in claim 1, wherein the plurality of layers comprise layers of woven fabric comprising warp and weft carbon fibre yarns encapsulated within a polymer matrix.

11. The base as claimed in claim 10, wherein the polymer matrix is an epoxy-based resin.

12. The base as claimed in claim 10, wherein the layers of woven fabric are each woven in a balanced plain weave.

13. The base as claimed in claim 10, wherein the layers of the woven fabric are oriented relative to one another and to the longitudinal axis of the sole such that in some of the layers the warp or weft yarns are angled with respect to the longitudinal axis of the sole and in at least one of the layers either the warp yarns or the weft yarns are aligned with the longitudinal axis of the sole.

14. The base as claimed in claim 10, wherein the laminate comprises at least seven layers of woven fabric.

15. The base as claimed in claim 14, wherein at least six of the layers are oriented such that their warp and weft yarns are angled at 45°±10° to the longitudinal axis of the sole and a seventh layer is oriented such that either its warp yarns or its weft yarns are aligned within ±20° of the longitudinal axis of the sole.

16. The base as claimed in claim 14, wherein the laminate comprises eight layers of woven fabric of which seven layers are oriented such that their warp and weft yarns are angled at 45°±10° to the longitudinal axis of the sole and the eighth layer is oriented such that its warp yarns or its weft yarns are aligned within ±20° of the longitudinal axis of the sole.

17. The base as claimed in claim 1, wherein the one or more outsole elements comprise rigid elastomeric elements that are bonded to the sole via an adhesive.

18. The base as claimed in claim 1, wherein the heel portion is integrally formed with an upstanding portion that is adapted to wrap up around the back and sides of the heel of a ski boot.

19. The base as claimed in claim 18, wherein the upstanding portion is adapted for connection to an ankle cuff.

20. The base as claimed in claim 1, wherein the heel portion defines an interior cavity.

21. The base as claimed in claim 20, wherein a resilient pad is secured within the cavity to provide heel lift and to cushion the foot during use.

22. The base as claimed in claim 1, wherein either the outsole elements or the sole is provided with at least two projections and the other of the outsole elements and the sole is provided with at least two holes or cavities, and further wherein the one or more outsole elements are positioned on the sole in a predetermined position by inserting the at least two projections into the at least two holes or cavities.

23. The base as claimed in claim 22, wherein the projections are integrally formed with said outsole element.

24. The base as claimed in claim 22, wherein the projections are formed by injected pins, rivets, fasteners, t-nuts, or screws that locate into the cavities or holes defined by the sole.

25. A ski boot incorporating the base comprising the one-piece sole as recited in claim 1 and to which is secured one or more outsole elements.

26. The ski boot as claimed in claim 25, wherein the mid-section of the sole is located between a toe portion and a heel portion of the sole and wherein the one or more outsole elements comprise a toe outsole element secured to the toe portion and a heel outsole element secured to the heel portion.

27. The ski boot as claimed in claim 26, wherein the toe and heel outsole elements comprise rigid elastomeric elements that are bonded to the sole via an adhesive.

28. The ski boot as claimed in claim 25, wherein the majority of the fibers in the mid-section of the sole are angled at 45°±10° to the longitudinal axis of the sole.

29. The ski boot as claimed in claim 25, wherein the one or more outsole elements further comprise a rigid bar outsole element that is fastened to the sole via at least two fasteners that penetrate through the sole.

30. The ski boot as claimed in claim 29, wherein the one or more outsole elements comprise a toe outsole element that is secured to the toe portion of the sole and further wherein the rigid bar is fastened directly to the sole adjacent the toe outsole element.

31. The ski boot as claimed in claim 29, wherein the one or more outsole elements comprise a toe outsole element that is secured to the toe portion of the sole wherein a forward end of the toe outsole element is located between the rigid bar and the sole, the fasteners penetrating through the toe outsole element into and through the sole.

32. The ski boot as claimed in claim 25 further comprising a flexible fabric upper fixed to the base.

33. The ski boot as claimed in claim 32, wherein the heel portion wraps around a back and sides of the flexible fabric upper.

34. The ski boot as claimed in claim 33, wherein the heel portion is connected to an ankle cuff in a hinged manner.

* * * * *